US005120014A

United States Patent [19]

Chou

[11] Patent Number: 5,120,014

[45] Date of Patent: Jun. 9, 1992

[54] READING MATERIAL SUPPORT

[76] Inventor: Wayne W. Chou, 25 Hayley Pl., Ridgefield, Conn. 06877

[21] Appl. No.: 707,854

[22] Filed: May 30, 1991

[51] Int. Cl.[5] ..... A47B 97/04

[52] U.S. Cl. ..... 248/451; 281/45

[58] Field of Search ..... 248/451, 452, 453, 206.5, 248/441; 40/531, 341, 449; 281/45

[56] References Cited

U.S. PATENT DOCUMENTS

| | | | |
|---|---|---|---|
| 60,833 | 1/1867 | Clark . | |
| 590,761 | 9/1897 | Hill . | |
| 606,924 | 7/1898 | Hale | 248/451 |
| 951,334 | 3/1910 | Peterson | 248/451 |
| 1,032,817 | 7/1912 | Dalboni et al. . | |
| 1,368,897 | 2/1921 | Civil | 248/451 |
| 1,451,614 | 4/1923 | Hoecke . | |
| 2,025,510 | 12/1935 | Hysmith | 248/441 |
| 2,710,471 | 6/1955 | Staunton et al. . | |
| 2,975,544 | 3/1961 | Lutterberg | 248/451 |
| 3,061,969 | 11/1962 | Lunday | 248/451 X |
| 3,343,776 | 9/1967 | Wieszeck | 248/441 |
| 3,371,571 | 3/1968 | Barbera | 40/531 |
| 3,586,847 | 6/1971 | Nahmias | 248/451 X |
| 3,677,510 | 7/1972 | Kenwell | 248/441 |
| 3,874,103 | 4/1975 | Muta | 40/600 |
| 4,258,493 | 3/1981 | Kettlestrings | 40/600 |
| 4,474,383 | 10/1984 | Kikis | 281/45 |
| 4,773,297 | 9/1988 | Anderson | 40/531 |

FOREIGN PATENT DOCUMENTS

| | | | |
|---|---|---|---|
| 2222386 | 3/1990 | United Kingdom | 281/45 |

*Primary Examiner*—J. Franklin Foss

*Attorney, Agent, or Firm*—Parmelee, Bollinger & Bramblett

[57] ABSTRACT

A flat support is provided on which an open multiple page bound volume of printed material is adapted to be supported. First and second arms are positioned on opposite sides of the open volume on first and second elevated platforms which are mounted on opposite sides of the support. The first and second arms are pivotally mounted on the first and second platform which in one orientation of pivoted movement, the arms face each other when in position for holding a volume thereunder on a support. First and second magnets are mounted on the first and second arms to hold by magnetic attraction individual pages of a volume having magnetic material positioned thereon in magnetic alignment with the first and second magnets whereby individual pages may be read released and turned by the user while the volume is held in open position which turned pages are also held in position while the next succeeding page is magnetically held in position for reading. Thus a reading material support is provided for holding multiple paged, bound, printed materials in an open position while still permitting the turning and holding of a plurality of individual pages of immediate interest in proper reading position while freeing the hands of the user.

4 Claims, 1 Drawing Sheet

READING MATERIAL SUPPORT

BACKGROUND OF THE INVENTION

This invention relates to a reading material support, and more particularly to such a support for holding a multiple page bound volume of printed material in an open position while still permitting the turning and holding of a plurality of individual pages of immediate interest in proper reading position while freeing the hands of the user.

Players of keyboard instruments such as pianos, organs and the like often play using a bound volume containing a large number of different songs and/or lengthy pieces of music. When using such a bound volume whether thick or thin a problem exists in keeping the volume open to the pages desired to be read and played. Many different approaches have been used to treat this problem, for example, U.S. Pat. No. 3,952,989. In the aforesaid patent a pair of fixed arms hold the book open while a plurality of fingers (37) and (39) hold the pages in place and must be pulled forwardly against the biasing action of a spring while the page is being turned and then releasing the fingers to engage and hold the next page. Such structure is complex and requires the use of both hands which would provide a difficult transition when playing music.

A variety of page turning devices have been suggested, for example, as illustrated in U.S. Pat. No. 60,333, and 3,343,776. U.S. Pat. No. 3,677,510 provides a holder using a lightweight roller which engages the pages of a book and keeps them from turning until the roller is removed. Once again this type of structure would be unsuitable for a number of applications particularly the playing of music.

In addition to the U.S. Pat. No. 60,333 cited above U.S. Pat. Nos. 1,368,894 and 2,975,544 employ various forms of magnetic structure for holding books open.

Many of these known supports are either mechanically complex or are difficult to operate or require effort and dexterity beyond the capability of the user. Additionally, many of these devices are simply not suitable for those uses requiring the users hands to be free for performing other activities like playing music.

SUMMARY OF THE INVENTION

Accordingly it is an object of this invention to provide a new and improved reading material support which is portable and simple to use.

Another object of this invention is to provide a new and improved reading material support which is capable of holding a multiple page bound volume of printed material in open position while still permitting the turning and holding of a plurality of individual pages of immediate interest in proper reading position while freeing the hands of the user for other purposes.

Still a further object of this invention is to provide a new and improved reading material support whether the reading material is in the form of a hard or soft copy book, magazine or the like which reading material is releasably mounted upon the support in a manner which permits the turning of pages of the reading material of immediate interest.

In carrying out this invention in one illustrative embodiment thereof, a reading material support is provided for holding a multiple page bound volume of printed material in an open position while still permitting the turning and holding of a plurality of individual pages of immediate interest in proper reading position while freeing the hands of the user. A flat support is provided for supporting an open bound volume which includes first and second arms positioned on opposite sides of the open volume which are mounted on first and second elevated platforms on opposite sides of the support. First and second hinge means are provided for pivotally mounting the first and second arms on the first and second platforms in which in one pivoted orientation of said arms, the arms face and extend toward each other when in position for holding a volume thereunder. First and second magnetic means are mounted on the first and second arms, respectively, which are adapted to hold by magnetic attraction individual pages of said volume having magnetic material positioned thereon in magnetic alignment with the first and second magnetic means whereby individual pages may be released and turned which turned pages are held in position while the next succeeding page is magnetically held in position for reading.

BRIEF DESCRIPTION OF THE DRAWINGS

The invention, together with further objects, aspects, advantages and features thereof will be more clearly understood from the following description taken in connection with the accompanying drawings.

DESCRIPTION OF THE PREFERRED EMBODIMENTS

Figure 1:
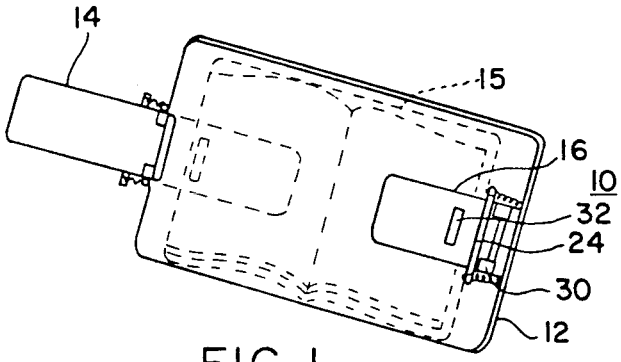
FIG. 1 is a top elevational view of a reading material support embodied in the present invention illustrating a volume in phantom positioned in this support with one arm pivoted open away from the volume and one arm pivoted closed and bearing on the phantom volume.

Referring now to FIG. 1, a reading material support referred to generally with the reference numeral (10) is provided with flat support (12) for supporting an open volume (15) which is held thereon by arms (14) and (16). The word volume as used herein is defined as a collection of written or printed material whether in book or magazine form or whether in hard cover or soft cover.

Figure 4:
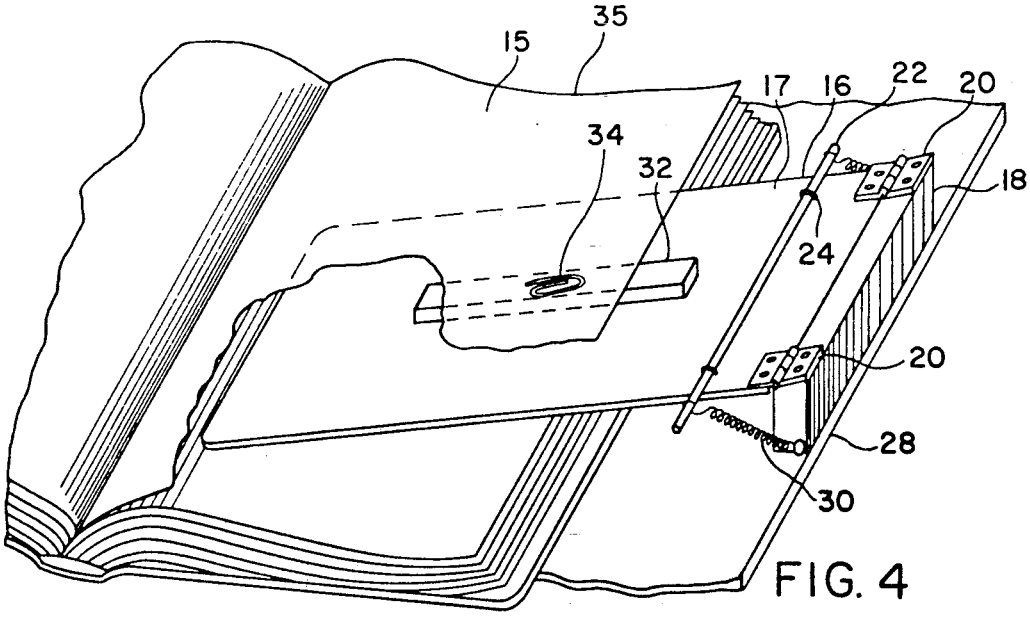
FIG. 4 is a large isometric view of one of the volume holding arms in operative position on a volume, and also illustrating magnetically holding individual pages of the volume on the top of the volume holding arm.

As will best be seen in FIG. 4, arm (16) is pivotally mounted on a platform (18) by hinges (20). The arm (16) has a rod (22) mounted thereon by staples (24) or any other suitable mounting means to which springs (30) are attached after being anchored by screws (28) to the platform (18). The pivoted structure of the arm (16) as shown in FIG. 4 is identical for the arm (14) and is labeled with the same reference numerals for like elements.

The arm (16) as shown in FIG. 4 is provided with a magnet (32) which is mounted directly on the arm as shown. The magnet (32) is mounted on the upper surface of the arm (16) on which individual pages (35) of the volume (15) may be held. Each such individual page is provided with a small piece of magnetic material (34) such as a paper clip, or other imbedded or attached magnetic material which will be attracted and held by the magnet (32). The magnetic material (34) is affixed to the page (35) in magnetic alignment with respect to the magnet (32) so that it comes under the influence of the magnetic field of the magnet (32) in order to attract and retain the page (35) in position on top of the magnet (32).

As will be seen in FIG. 1 in employing the reading material support (10) in accordance with the present invention, the volume (15) is opened and held on the support by pivoting the arms (14) and (16) inward in which orientation the arms (14) and (16) face each other and bear on the central portion of each side of the open book. The hinged arms (14) and (16) with the spring loading provided by the springs (30) provide the necessary strength for the arms (14) and (16) to bear on the central portion of the book to hold part or most of the pages open as the case may be. On the other hand, the magnets (32) and the clips of magnetic material (34) are used only to hold a few pages of immediate interest and allowing those pages of interest to lay flat, but also to be held flat after they have been turned from one magnet on one side of the volume to engage the magnetic field of the other magnet on the other side of the volume.

Figure 3:
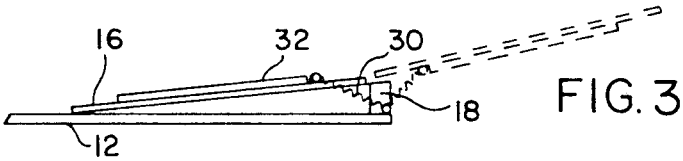
FIG. 3 illustrates a front elevational view of one of the volume holding arms in closed position with the volume omitted and in open position in phantom.

FIG. 3 shows the pivoted action of arm (16) in a closed position bearing against the support (12) in a spring loaded position. When the arm (16) is pivoted slightly less then 180 Degrees as shown in phantom on FIG. 3 the springs (30) are unloaded preparing the arm to receive a volume (15) when it is in open position on the support (12).

Figure 2:
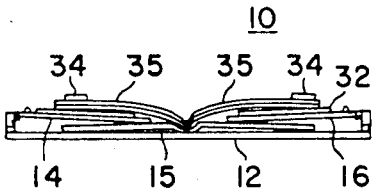
FIG. 2 is a front elevational view of FIG. 1 showing a volume positioned on the reading material support with both arms holding the book on the support and with plurality of pages being supported magnetically on the arms holding the volume on the support.

As is shown in FIG. 2, volume (15) is opened and held by the arms (14) and (16) in its open position leaving a plurality of individual pages (35) each of which has a magnetic material (34) positioned thereon which when in place on either the right or left side of the volume (15) will be influenced by the magnetic field of the magnets (32). Accordingly, the individual pages (35) will be magnetically attached and held in a position on the right or the left of the volume so that the pages can be clearly viewed and when finished the user may turn the page, releasing that material in that page to come under the influence of the magnetic field of the magnet on the other side of the volume. In this regard it should be pointed out that without the spring loaded arms (14) and (16) the strength of the magnets would have to be extremely great to hold the volume open and to hold the open pages flat. It should be noted that in accordance with the present invention several pages (35) may be held at one time and turned individually. In the present invention, a single magnet (32) is provided on each arm (14) and more than one magnetic clip or material (34) can be stacked since magnetic attraction may take place due to the magnetic field of the magnet (32) which will go through several layers or pages of paper.

As will be seen in FIG. 1, the magnets have a vertical orientation with respect to the arms (14) and (16). In the embodiments of FIG. 2 through FIG. 4, a horizontal orientation of the magnets (32) is provided which in effect permits or accommodates various widths of books magazines and the like which are not all standard. The main thing is that the pages which have to be held have magnetic material thereon which comes into magnetic alignment with the magnets (32) regardless of their positioning or orientation or size on the arms (14) and (16).

As pointed out, a particularly useful application of the present invention relates to its use for keyboard musicians who sometimes play music from assembled collections of songs or music assembled in a volume which simply is difficult to hold open and to turn pages in without completely losing the place not to mention the interruption of play when the hands are involved in trying to open and hold open and turn pages of a multiple page volume. In accordance with the present invention, a few pages of interest are positioned above the clamped open volume and these few open pages are held flat and readable and may be turned by the user in a simple efficient manner and will be retained when turned to permit the user free hands for the continuation of play. The invention, of course, is not restricted for this particular application and may be useful to be applied to any stand or table which is designed to support printed material for viewing such as lecture stands, desks with inclined holders, hospital reading platforms and the like. The reading material support of the present invention is portable and easy to use even for the infirm.

Since other changes and modifications vary to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereof.

What is claimed is:

1. A reading material support for holding a multiple pages, bound volume of printed material in an open position while still permitting the turning and holding of a plurality of individual pages of immediate interest in proper reading position while freeing the hands of a user comprising:

a flat support on which an open multiple page, bound volume of printed material is adapted to be supported;

first and second elongated arms adapted to face each other and to bear on a central portion on opposite sides of said open volume while permitting a plurality of pages of immediate interest to be supported on top of said first and second arms;

first and second elevated platforms mounted on opposite sides of said support;

first and second hinge means for pivotally mounting said first and second arms on said first and second platforms in which one pivoted orientation of said arms, the arms face and extend toward each other when in position for holding an open volume thereunder; and first and second magnetic means mounted on said first and second arms respectively, adapted to hold by magnetic attraction individual pages of said volume having magnetic material positioned thereon in magnetic alignment with said first and second magnetic means whereby individual pages of immediate interest may be read, released and turned by the user which turned pages are held in a flat position on said arms while the next succeeding page is magnetically held on one of said arms in a flat position for reading.

2. The reading material support as claimed in claim 1 wherein said first and second arms having spring means attached thereto for spring loading said arms when pivoted against a volume positioned on said support.

3. The reading material support as claimed in claim 1 wherein said first and second magnetic means comprises a magnet positioned vertically on said arms.

4. The reading material support as claimed in claim 1 wherein said first and second magnetic means comprises a magnet positioned horizontally on said arms.

* * * * *